United States Patent [19]

Hutton, Jr. et al.

[11] Patent Number: 4,920,171

[45] Date of Patent: Apr. 24, 1990

[54] WATER-RESISTANT, WATER-FLUSHABLE PAPER COMPOSITIONS

[75] Inventors: Alexander E. Hutton, Jr., Peterborough; Richard E. Burke, Amherst; Stanley P. Wheeler, Jr., Peterborough, all of N.H.

[73] Assignee: Monadnock Paper Mills, Inc., Bennington, N.H.

[21] Appl. No.: 17,910

[22] Filed: Feb. 24, 1987

[51] Int. Cl.[5] ..... C08K 3/36

[52] U.S. Cl. ..... 524/446; 524/445; 524/447; 524/586; 428/340; 428/913

[58] Field of Search ..... 524/445, 446, 447, 586

[56] References Cited

U.S. PATENT DOCUMENTS

| | | | |
|---|---|---|---|
| 4,263,870 | 4/1981 | Saito et al. | 427/428 |
| 4,374,670 | 2/1983 | Slocombe | 524/460 |
| 4,376,654 | 3/1983 | Zola | 524/27 |
| 4,550,131 | 10/1985 | Yats | 524/522 |
| 4,672,701 | 6/1987 | Kocsis | 428/288 |

OTHER PUBLICATIONS

Dow Chemical Co., Specification Sheet for Dow PRIMACOR TM 4990, Form No. 305-1168-284, 1984.

*Primary Examiner*—Herbert J. Lilling

*Attorney, Agent, or Firm*—Shoemaker and Mattare, Ltd.

[57] ABSTRACT

The invention is directed to a coating composition for application to a flushable cellulosic based waterleaf sheet to impart transitory water repellency to at least one surface of the sheet. The composition comprises between 20% by weight to about 70% by weight of relatively large particle size delaminated clay in combination with a polyethylene based polymer that has been produced by the drying of a colloidal polyethylene in water composition with the said clay.

3 Claims, No Drawings

WATER-RESISTANT, WATER-FLUSHABLE PAPER COMPOSITIONS

FIELD OF THE INVENTION

The present invention relates to paper making and paper products and more particularly to a paper product and its method of manufacture and compositions used in its manufacture which renders the resultant paper product suitable for applications requiring water repellency while retaining the property of being flushable.

Previously, it has not been fully possible to provide paper products which were flushable such as toilet tissues, which were at the same time of sufficient strength, particularly when wetted to be suitable for uses which required those properties.

It is therefore an objective of the present invention to provide a paper product which can be fabricated or converted into articles which are flushable while, at least temporarily, exhibiting sufficient water repellency and wet strength to be used in a manner where the article retains its strength and shape when wetted.

It is a further objective of the present invention to provide a method of manufacturing a paper product having the properties previously described, and to provide a composition for use in the manufacture of a paper product which will achieve the properties described more fully hereinafter.

The foregoing and further objects and advantages of the present invention will become apparent from the description hereinafter of the preferred embodiments of the present invention.

BRIEF DESCRIPTION OF THE INVENTION

The paper product of the present invention achieves the foregoing objectives and others by a combination of several factors which utilizes the application of the paper making process. First is that for such a product to have broad utility the paper base or web should be formulated so as to be capable of being made on nearly any standard paper making equipment. Next the paper should be treated with a modest amount of a wet strength resin in such a manner so as to impart the desired temporary wet strength while remaining essentially readily wettable by the prolonged application of aqueous solutions such as by flushing into a waste treatment environment. Lastly the paper of the present invention should be capable of being fabricated into a wide range of basis weights, calipers, Gurley Porosity and Klemm values. These competing factors can be balanced where the water leaf or flushable paper product is coated subsequent to manufacture with a predetermined amount of composition comprising a preselected proportion of a colloidal polyethylene or a styrene butadiene latex and a preselected proportion of a clay from an ammonia containing water slurry.

DETAILED DESCRIPTION OF THE INVENTION

Preferably the method and article of the present invention can be fabricated using conventional paper making technology on a Fourdrinier, rotoformer, deltaformer machine or the like. Almost any combination of fibers which can be used in such processes can be employed herein. For example, the sheet may consist of hardwood kraft, softwood kraft, mercerized fiber, cotton and synthetic fibers in a wide variety of proportions.

Typically a formulation such as that shown in TABLE I can be employed with the present invention.

TABLE I

| Materials | Parts |
|---|---|
| Hardwood Kraft | 74.8 |
| Softwood Kraft | 15.0 |
| Mercerized Kraft | 10.0 |
| Aluminum Sulfate | 0.05 |
| Melamine Wet Strength | 0.15 |
| | 100.00 |

It is desirable to add a minimal amount of wet strength resin, such as melamine formaldehyde, urea formaldehyde, or a neutral cure wet strength material since the sheet must be a flushable waterleaf sheet. Some resin must be employed however to provide the waterleaf sheet with sufficient wet strength to enable it to withstand the further processing required for the present invention.

The other characteristics of the paper product which have been found to make a product suitable for use in the present invention are summarized in TABLE II.

TABLE II

| | | |
|---|---|---|
| Basis weight 24 × 36/500 | 20.0–80 | pounds |
| Caliper in mils | 1.8–8 | |
| Klemm | 10.0–30 | |
| Gurley Porosity | 0.0–50 | |

The paper product previously described, is then subjected to a coating process to achieve the advantages described herein. The coating is applied from an aqueous solution or slurry in a conventional manner after the paper has been dried to about 3–4% moisture. The coating composition preferably comprises a colloidal polyethylene, such as Dow Primacro TM 4990, and preferably a large particle, delaminated clay. The proportions of clay employed in the composition can be varied widely with between about 20% to about 70% by dry weight of the composition. The delaminated clay is preferred since the clay must provide a barrier against the passage of water into the waterleaf sheet. This is important since the wet strength of the uncoated sheet is quite low due to the minimal use of wet strength resins in the fabrication of the uncoated sheet. The clay in the coating composition therefore must be selected to be capable of preventing, as much as possible, the penetration of the aqueous based coating composition into the waterleaf sheet in order to prevent the coating operation from destroying the integrity of the sheet itself. The clay selected is a natural clay with a wide range of particle sizes, preferably 60% being below 2 microns in size.

The following TABLE III shows typical formulations in parts which exemplify the range of clay use possible in the coatings.

TABLE III

| 20% by Dry Weight Clay | | 70% by Dry Weight Clay | |
|---|---|---|---|
| Primacor 4990 | 84.8 | Primacor 4990 | 37.8 |
| Clay (Dry) | 7.4 | Clay (Dry) | 30.9 |
| Ammonia | 0.4 | Ammonia | 0.4 |
| Water | 7.4 | Water | 30.9 |
| | 100.0% | 100.0% | |
| | Wet Weight | | Wet Weight |

The coating operation, properly preformed, with a suitable coating composition, will not interfere with the intrinsic wetability of the base waterleaf sheet. The composition should therefore be formulated so that it remains, almost entirely on the surface, or close to the surface of the base waterleaf sheet. In this manner the intrinsic wetability of the base sheet will not become a processing problem and the finished sheet will have the desirable properties described herein. The composition of TABLE III is an example of a composition which can effectively produce the product and article of the present invention in the described process.

TABLE IV

| Materials | Parts |
|---|---|
| Colloidal Polyethylene (Dow Primacor TM 4990) | 60.2 (35% solids) |
| Clay Dry | 20.8 |
| Ammonia | 0.3 |
| Water | 18.7 |
| | 100.0 |

Preferably, the coating composition of the present invention should be applied in a rate so as to produce a coverage of from about 3 pounds to about 10 pounds of coating for every 3,000 square feet of base sheet. The coating may be applied by rod coaters, short dwell coaters, blade coaters, and the like, and dried by forced hot air. The drying is greatly assisted by the use of IF dryers immediately after the coating application which will set the coating rapidly and reduce penetration. The drying temperature is not critical because this coating is not apt to blister in this application.

In addition to the foregoing embodiment it is also possible to utilize other resins and polymers in a coating compositions useful in the product and process of the present invention. An example of another composition is shown in TABLE V.

TABLE V

| Materials | Parts |
|---|---|
| Styrene Butadiene Latex | 46.6 |
| Wax Emulsion | 6.7 |
| Clay | 23.3 |

TABLE V-continued

| Materials | Parts |
|---|---|
| Ammonia | 0.3 |
| Water | 23.1 |
| | 100.0 |

The styrene-butadiene latex selected for use in the foregoing coating composition was obtained from Dow Chemical Company and identified as Dow 620. The wax emulsion, such as Hercules Paracol is typical of this formulation. Other materials can be substituted in the coating composition if they exhibit the appropriate barrier characteristics both during the coating operation and during subsequent use.

The foregoing description of the present invention is exemplary and the invention is only to be limited in scope by the prior art as applied to the following claims.

I claim:

1. A coating composition for application to a flushable cellulosic based waterleaf sheet and for imparting transitory water repellency to at least one surface of said flushable cellulosic waterleaf sheet when applied on said waterleaf sheet at a coverage of from about three pounds to about 10 pounds of coating for every 3,000 square feet of waterleaf sheet, said coating composition consisting essentially of between 20% by weight to about 70% by weight of relatively large particle size delaminated clay, with the balance being a polyethylene based resin composition produced by the drying of a colloidal polyethylene in water composition together with said clay; whereby the resultant surface coating provides surface water repellency without impairing the ability of the waterleaf sheet to be disposed of by flushing.

2. The coating composition of claim 1 in which said balance of colloidal polyethylene comprises about 55 to about 65 parts by weight of a 50% solids aqueous suspension of said polyethylene, the balance being clay and water.

3. The coating composition of claim 2 wherein said colloidal polyethylene is present in an amount of about 60 parts by weight of said aqueous coating composition.

* * * * *